US006718152B2

(12) United States Patent
Geervasi et al.

(10) Patent No.: US 6,718,152 B2
(45) Date of Patent: Apr. 6, 2004

(54) FULLY FLUORINATED POLYMER COATED DEVELOPMENT ELECTRODES

(75) Inventors: David J. Geervasi, West Henrietta, NY (US); Santokh S. Badesha, Pittsford, NY (US); George J. Bingham, Savannah, GA (US)

(73) Assignee: Xerox Corporation, Stamford, CT (US)

( * ) Notice: Subject to any disclaimer, the term of this patent is extended or adjusted under 35 U.S.C. 154(b) by 2 days.

(21) Appl. No.: 10/199,096

(22) Filed: Jul. 18, 2002

(65) Prior Publication Data

US 2004/0013450 A1 Jan. 22, 2004

(51) Int. Cl.[7] ..... G03G 15/08
(52) U.S. Cl. ..... 399/266; 428/195.1; 430/120
(58) Field of Search ..... 399/266, 265, 399/290, 291; 361/214, 222; 430/120; 428/195.1, 421

(56) References Cited

U.S. PATENT DOCUMENTS

| | | | | |
|---|---|---|---|---|
| 5,225,561 A | | 7/1993 | Kirlin et al. | 546/256 |
| 5,280,012 A | | 1/1994 | Kirlin et al. | 505/447 |
| 5,439,768 A | | 8/1995 | Matsuo et al. | 430/56 |
| 5,453,494 A | | 9/1995 | Kirlin et al. | 534/15 |
| 5,488,601 A | | 1/1996 | Sakano et al. | 369/120 |
| 5,492,783 A | | 2/1996 | Utsumi et al. | 430/48 |
| 5,504,195 A | | 4/1996 | Leedham et al. | 534/15 |
| 5,527,589 A | | 6/1996 | Iijima et al. | 428/195 |
| 5,571,646 A | | 11/1996 | Utsumi et al. | 430/48 |
| 5,629,920 A | | 5/1997 | Sakano et al. | 369/120 |
| 5,721,042 A | | 2/1998 | Iijima et al. | 428/195 |
| 5,731,116 A | | 3/1998 | Matsuo et al. | 430/56 |
| 5,750,238 A | | 5/1998 | Iijima et al. | 428/195 |
| 5,778,290 A | * | 7/1998 | Badesha et al. | 399/266 |
| 5,848,327 A | * | 12/1998 | Badesha et al. | 399/266 X |
| 5,892,083 A | | 4/1999 | Winter et al. | 556/412 |
| 5,903,296 A | | 5/1999 | Shimizu et al. | 347/139 |
| 5,981,123 A | | 11/1999 | Matsuo et al. | 430/48 |
| 5,999,781 A | * | 12/1999 | Gervasi et al. | 399/266 |
| 6,126,996 A | | 10/2000 | Kirlin et al. | 427/252 |
| 6,456,812 B1 | * | 9/2002 | Gervasi et al. | 399/266 |
| 6,557,990 B2 | * | 5/2003 | Altendorf | 347/92 |

FOREIGN PATENT DOCUMENTS

| | | |
|---|---|---|
| EP | 0 875 799 A2 * | 11/1998 |
| EP | 1 186 963 A2 * | 3/2002 |
| JP | 10-333425 * | 12/1998 |

OTHER PUBLICATIONS

Catalysis in the Fluorous Biphase, Hope, E. G., http://www.le.ac.uk/chemistry/research/epsrc/egh1.html.

Fluorous Synthesis: A Fluorous–Phase Strategy for Improving Separation Efficiency in Organic Synthesis, Studer, A., Hadida, S., Ferritto, R., Kim, S., Jeger, P. Wipf, P., Curran, D., *Science Magazine*, Feb. 7, 1997 vol. 275, p. 823–826 , http://www.sciencemag.org.

Facile Catalyst Separation Without Water: Fluorous Biphase Hydroformylation of Olefins, Horvath, I., Rabal, J., *Science Magazine*, Oct. 7, 1994, vol. 266, p. 72–75.

Facile Catalyst Separation without Water: Fluorous Biphase Hydroformylation of Olefins, Horvath, I.T., Rabal, J., *CHEMTRACTS, Inorganic Chemistry, 1995*, vol. 7, No. 1, p. 14–18.

A Soluble Fluorous Phase Polymer Support, Bergbreiter, D., Franchina, J., *Chem. Commun., 1997*, p. 1531–1532.

(List continued on next page.)

*Primary Examiner*—Sophia S. Chen
(74) *Attorney, Agent, or Firm*—Annette L. Bade

(57) ABSTRACT

An apparatus for reducing accumulation of toner from the surface of an electrode member in a development unit of an electrostatographic printing apparatus by providing a coating having a polymer with a fully fluorinated polymer on at least a portion of the electrode member.

21 Claims, 4 Drawing Sheets

OTHER PUBLICATIONS

Solubility Enhancement of Phenol and Phenol Derivatives in Perfluorooctyl Bromide, Williams, T. , Jay, M., Lehmler, H., Clark, M., Stalker, D., Bummer, P., *Journal of Pharmaceutical Sciences*, Dec. 1998, vol. 87, No. 12, p. 1585–1589.

Phosphorous (III) ligands in fluorous biphase catalysis, Bhattacharyya, P., Croxtall, B., Fawcett, Joanne, Fawcett, John, Gudmunsen, D., Hope, E., Kemmitt, R., Paige, D., Russell, D., Stuart, A., Wood, D., *Journal of Fluorine Chemistry 101, 2000*, p. 247–255.

The rhodium catalysed hydrogenation of styrene in the fluorous biphase, Hope, E., Kemmitt, R., Paige, D., Stuart, A., Wood, D., *Journal of Fluorine Chemistry 99, 1999*, p. 197–200.

Fluorous biphase catalysis, Hope, E., Stuart, A., *Journal of Fluorine Chemistry 100, 1999*, p. 75–83.

Behavior of partially fluorinated carboxylic acids at the air–water interface, Lehmler, H., Oyewumi, M., Jay, M., Bummer, P., *Journal of Fluorine Chemistry 107, 2001*, pp. 141–146.

* cited by examiner

FULLY FLUORINATED POLYMER COATED DEVELOPMENT ELECTRODES

CROSS REFERENCE TO RELATED APPLICATIONS

Reference is made to co-pending, commonly-assigned, U.S. patent application Ser. No. 10/137,789 filed May 2, 2002, entitled, "Organometallic Coating Compositions For Development Electrodes;" U.S. patent application Ser. No. 10/199,927 filed Jul. 18, 2002, entitled, "Processes for Solubilizing Organometallic Compounds in Fluorinated Solvents by Addition of a Fluorinated Non-Catalytic Co-Solubilizer;" and, U.S. patent application Ser. No. 10/199,619 filed Jul. 18, 2002 entitled, "Coatings Having Fully Fluorinated Co-Solubilizer, Metal Material and Fluorinated Solvent," the subject matter each of which is hereby incorporated by reference in its entirety.

BACKGROUND OF THE INVENTION

The present invention relates to methods, processes and apparatii for development of images, and more specifically, to electrode members for use in a developer unit in electrophotographic machines. Specifically, the present invention relates to methods and apparatii in which at least a portion of a development unit electrode member is coated with a coating material, and in embodiments, a low surface energy coating material comprising a fully fluorinated polymer. In embodiments, the fully fluorinated polymer is soluble in fluorinated solvents. In embodiments, electrode member history, damping and/or toner accumulation is controlled or reduced. In embodiments, the coating comprises a fully fluorinated polymer, a fluorinated solvent, and a metal material. In embodiments, the metal material is a superconductor or a superconductor precursor. In embodiments, the fully fluorinated polymer acts as a co-solubilizer, making soluble in fluorinated solvents, materials which are not normally soluble in fluroinated solvents.

Generally, the process of electrophotographic printing includes charging a photoconductive member to a substantially uniform potential so as to sensitize the photoconductive member thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to the development zone. At least one, and up to a plurality of electrode members are closely spaced to the donor roll in the development zone. An AC voltage is applied to the electrode members forming a toner cloud in the development zone. The electrostatic fields generated by the latent image attract toner from the toner cloud to develop the latent image.

Another type of a two component development system is a hybrid scavengeless development system, which employs a magnetic brush developer roller for transporting carrier having toner adhering triboelectrically thereto. A donor roll is used in this configuration also to transport charged toner to the development zone. The donor roll and magnetic roller are electrically biased relative to one another. Toner is attracted to the donor roll from the magnetic roll. The electrically biased electrode members detach the toner from the donor roll forming a toner powder cloud in the development zone, and the latent image attracts the toner particles thereto. In this way, the latent image recorded on the photoconductive member is developed with toner particles.

Various types of development systems have hereinbefore been used as illustrated by the following disclosures, which may be relevant to certain aspects of the present invention.

U.S. Pat. No. 4,868,600 to Hays et al., the subject matter of which is hereby incorporated by reference in its entirety, describes an apparatus wherein a donor roll transports toner to a region opposed from a surface on which a latent image is recorded. A pair of electrode members is positioned in the space between the latent image surface and the donor roll and is electrically biased to detach toner from the donor roll to form a toner cloud. Detached toner from the cloud develops the latent image.

U.S. Pat. No. 4,984,019, to Folkins, the subject matter of which is hereby incorporated by reference in its entirety, discloses a developer unit having a donor roll with electrode members disposed adjacent thereto in a development zone. A magnetic roller transports developer material to the donor roll. Toner particles are attracted from the magnetic roller to the donor roller. When the developer unit is inactivated, the electrode members are vibrated to remove contaminants therefrom.

U.S. Pat. No. 5,124,749 to Bares, the subject matter of which is hereby incorporated by reference in its entirety, discloses an apparatus in which a donor roll advances toner to an electrostatic latent image recorded on a photoconductive member wherein a plurality of electrode wires are positioned in the space between the donor roll and the photoconductive member. The wires are electrically biased to detach the toner from the donor roll so as to form a toner cloud in the space between the electrode wires and the photoconductive member. The powder cloud develops the latent image. A damping material is coated on a portion of the electrode wires at the position of attachment to the electrode supporting members for the purpose of damping vibration of the electrode wires.

U.S. Pat. Nos. 5,300,339 and 5,448,342 both to Hays et al., the subject matter each of which is hereby incorporated by reference in their entirety, disclose a coated toner transport roll containing a core with a coating thereover.

U.S. Pat. No. 5,172,170 to Hays et al., the subject matter of which is hereby incorporated by reference in its entirety, discloses an apparatus in which a donor roll advances toner to an electrostatic latent image recorded on a photoconductive member. The donor roll includes a dielectric layer disposed about the circumferential surface of the roll between adjacent grooves.

Primarily because the adhesion force of the toner particles is greater than the stripping force generated by the electric field of the electrode members in the development zone, a problem results in that toner tends to build up on the electrode members. Accumulation of toner particles on the wire member causes non-uniform development of the latent image, resulting in print defects. The problem is aggravated by toner fines and any toner components, such as high molecular weight, crosslinked and/or branched components, and the voltage breakdown between the wire member and the donor roll.

One specific example of toner contamination results upon development of a document having solid areas, which require a large concentration of toner to be deposited at a particular position on the latent image. The areas of the electrode member corresponding to the high throughput or high toner concentration areas tend to include higher or lower accumulation of toner because of this differing exposure to toner throughput. When the printer subsequently attempts to develop another, different image, the toner accumulation on the electrode member will lead to differential development of the newly developed image corresponding to the areas of greater or lesser toner accumulation on the electrode members. The result is a darkened or lightened band in the position corresponding to the solid area of the previous image. This is particularly evident in areas of intermediate density, since these are the areas most sensitive to differences in development. These particular image defects caused by toner accumulation on the electrode wires at the development zone are referred to as wire history. FIG. 5 contains an illustration of wire contamination and wire history. Wire contamination results when fused toner forms between the electrode member and donor member due to toner fines and any toner components, such as high molecular weight, crosslinked and/or branched components, and the voltage breakdown between the wire member and the donor roll. Wire history is a change in developability due to toner or toner components sticking to the top of the electrode member.

Accordingly, there is a specific need for electrode members in the development zone of a development unit of an electrophotographic printing machine, which provide for a decreased tendency for toner accumulation in order to decrease wire history and wire contamination, especially at high throughput areas, and decreasing the production of unwanted surface static charges from which contaminants may not release. One possible solution is to change the electrical properties of the wire. However, attempts at decreasing toner build-up on the development wire by changing the electrical properties thereof, may result in an interference with the function of the wire and its ability to produce the formation of the toner powder cloud.

Other attempts at reducing the accumulation of toner and to retaining electrical properties resulted in developer coating formulations for portions of the electrode wires.

U.S. Pat. No. 5,761,587, the subject matter of which is incorporated by reference herein in its entirety, discloses low surface energy coatings over a portion of the electrode wire.

U.S. Pat. No. 5,787,329, the subject matter of which is incorporated by reference herein in its entirety, discloses organic coatings of development electrodes.

U.S. Pat. No. 5,805,964, the subject matter of which is incorporated by reference herein in its entirety, discloses inorganic coatings of development electrodes.

U.S. Pat. No. 5,778,290, the subject matter of which is incorporated by reference herein in its entirety, discloses composite coated development electrodes.

U.S. Pat. No. 5,848,327, the subject matter of which is incorporated by reference herein in its entirety, discloses coating compositions for development electrodes.

U.S. Pat. No. 5,999,781, the subject matter of which is incorporated by reference herein in its entirety, discloses additional coating compositions for development electrodes.

Although the above newer coating formulations provided the desired properties of low surface energy, electrical conductivity and favorable tribo-charging against most toners and/or developer compositions, these formulations introduced roughness onto the surface morphology of the wire coating, due to limitations of process grinding of mineral fillers into the coating systems. Even a slight roughness introduces sufficient surface area to contribute to increased contamination of toner and toner additives.

Therefore, it is still desired to provide a coating for electrode members which has a greater decreased tendency to accumulate toner and which also retains the electrical properties of the electrode member in order to prevent interference with the functioning thereof. There is an additional need for electrode members which have superior mechanical properties such as a hard surface to provide increased durability against severe wear the electrode member receives when it is repeatedly brought into contact with tough rotating donor roll surfaces. Another desired mechanical property is a smooth electrode coating surface in order to decrease contamination of toner and toner additives.

SUMMARY OF THE INVENTION

Embodiments of the present invention include: an apparatus for developing a latent image recorded on a surface, comprising wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a polymer comprising a fully fluorinated polymer.

Embodiments further include: An apparatus for developing a latent image recorded on a surface, comprising wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a) a polymer comprising a fully fluorinated polymer and b) a fluorinated solvent.

In addition, embodiments include: an apparatus for developing a latent image recorded on a surface, comprising wire supports; a donor member spaced from the surface and being adapted to transport toner to a region opposed from the surface; an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a) a polymer comprising a fully fluorinated polymer, b) a fluorinated solvent, and c) a superconductor precursor.

BRIEF DESCRIPTION OF THE DRAWINGS

The above aspects of the present invention will become apparent as the following description proceeds upon reference to the drawings in which.

DETAILED DESCRIPTION

For a general understanding of the features of the present invention, a description thereof will be made with reference to the drawings.

Figure 1:
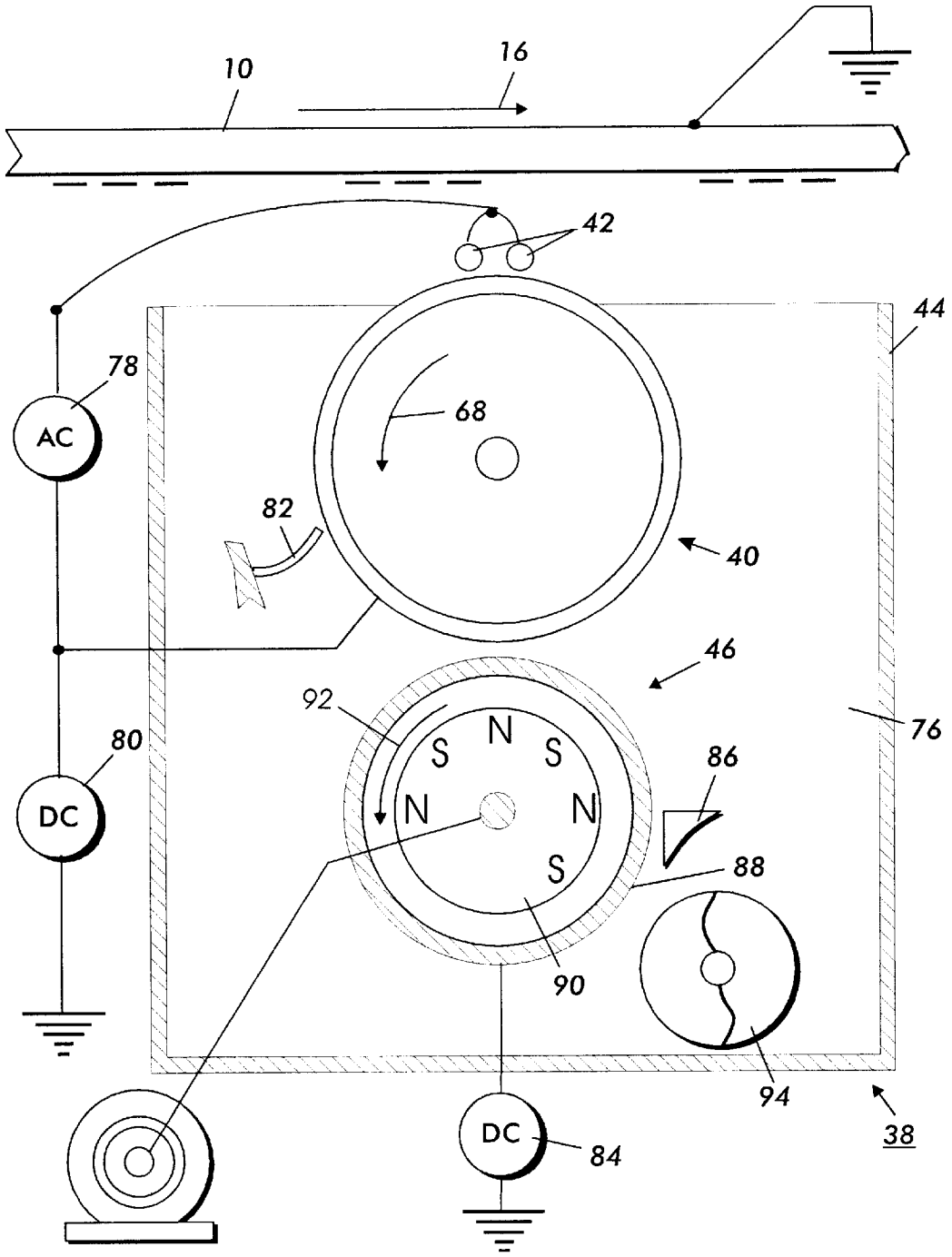
FIG. 1 is a schematic illustration of an embodiment of a development apparatus useful in an electrophotographic printing machine.

FIG. 1 shows a development apparatus used in an electrophotographic printing machine such as that illustrated and described in U.S. Pat. No. 5,124,749, the disclosure of which is hereby incorporated by reference in its entirety. This patent describes the details of the main components of an electrophotographic printing machine and how these components interact. The present application will concentrate on the development unit of the electrophotographic printing machine. Specifically, after an electrostatic latent image has been recorded on a photoconductive surface, a photoreceptor belt advances the latent image to the development station. At the development station, a developer unit develops the latent image recorded on the photoconductive surface.

Referring now to FIG. 1, in an embodiment of the invention, developer unit 38 develops the latent image recorded on the photoconductive surface 10, moving in the direction of arrow 16. In embodiments, developer unit 38 includes donor roller 40 and electrode member or members 42. Electrode members 42 are electrically biased relative to donor roll 40 to detach toner therefrom so as to form a toner powder cloud in the gap between the donor roll 40 and photoconductive surface 10. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller 46 disposed interior of the chamber of housing 44 conveys the developer material to the donor roller 40. The magnetic roller 46 is electrically biased relative to the donor roller so that the toner particles are attracted from the magnetic roller to the donor roller.

More specifically, developer unit 38 includes a housing 44 defining a chamber 76 for storing a supply of two component (toner and carrier) developer material therein. Donor roller 40, electrode members 42 and magnetic roller 46 are mounted in chamber 76 of housing 44. The donor roller can be rotated in either the 'with' or 'against' direction relative to the direction of motion of belt 10. In FIG. 1, donor roller 40 is shown rotating in the direction of arrow 68. Similarly, the magnetic roller can be rotated in either the 'with' or 'against' direction relative to the direction of motion of belt 10. In FIG. 1, magnetic roller 46 is shown rotating in the direction of arrow 92. Donor roller 40 can be made from anodized aluminum or ceramic.

Developer unit 38 also has electrode members 42, which are disposed in the space between the belt 10 and donor roller 40. A pair of electrode members is shown extending in a direction substantially parallel to the longitudinal axis of the donor roller. The electrode members are made from of one or more thin (i.e., 50 to 100 $\mu$m in diameter) stainless steel or tungsten electrode members which are closely spaced from donor roller 40. The distance between the electrode members and the donor roller is from about 5 to about 35 $\mu$m, or from about 10 to about 25 $\mu$m or the thickness of the toner layer on the donor roll. The electrode members are self-spaced from the donor roller by the thickness of the toner on the donor roller. To this end, the extremities of the electrode members supported by the tops of end bearing blocks also support the donor roller for rotation. The electrode member extremities are attached so that they are slightly above a tangent to the surface, including toner layer, of the donor structure. Mounting the electrode members in such a manner makes them insensitive to roll run-out due to their self-spacing.

As illustrated in FIG. 1, an alternating electrical bias is applied to the electrode members by an AC voltage source 78. The applied AC establishes an alternating electrostatic field between the electrode members and the donor roller is effective in detaching toner from the photoconductive member of the donor roller and forming a toner cloud about the electrode members, the height of the cloud being such as not to be substantially in contact with the belt 10. The magnitude of the AC voltage is relatively low and is in the order of 200 to 500 volts peak at a frequency ranging from about 9 kHz to about 15 kHz. A DC bias supply 80 which applies approximately 300 volts to donor roller 40 establishes an electrostatic field between photoconductive member of belt 10 and donor roller 40 for attracting the detached toner particles from the cloud surrounding the electrode members to the latent image recorded on the photoconductive member. At a spacing ranging from about 0.001 $\mu$m to about 45 $\mu$m between the electrode members and donor roller, an applied voltage of 200 to 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e., spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made from a metal such as aluminum and having the exterior circumferential is surface thereof roughened. An elongated magnet 90 is positioned interiorly of and spaced from the tubular member. The magnet is mounted stationary. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles, which may include toner and carrier particles. The toner dispenser is in communication with chamber 76 of housing 44. As the concentration of toner particles in the developer material is decreased, fresh toner particles are furnished to the developer material in the chamber from the toner dispenser. In an embodiment of the invention, the auger in the chamber of the housing mixes the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, in an embodiment of the invention wherein the toner includes carrier particles, the carrier granules include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 90% to is about 99% by weight of carrier and from 10% to about 1% by weight of toner. However, one skilled in the art will recognize that any other suitable developer material may be used.

In an alternative embodiment of the present invention, one component developer material consisting of toner without carrier may be used. In this configuration, the magnetic roller 46 is not present in the developer housing. This embodiment is described in more detail in U.S. Pat. No. 4,868,600, the disclosure of which is hereby incorporated by reference in its entirety.

Figure 2:
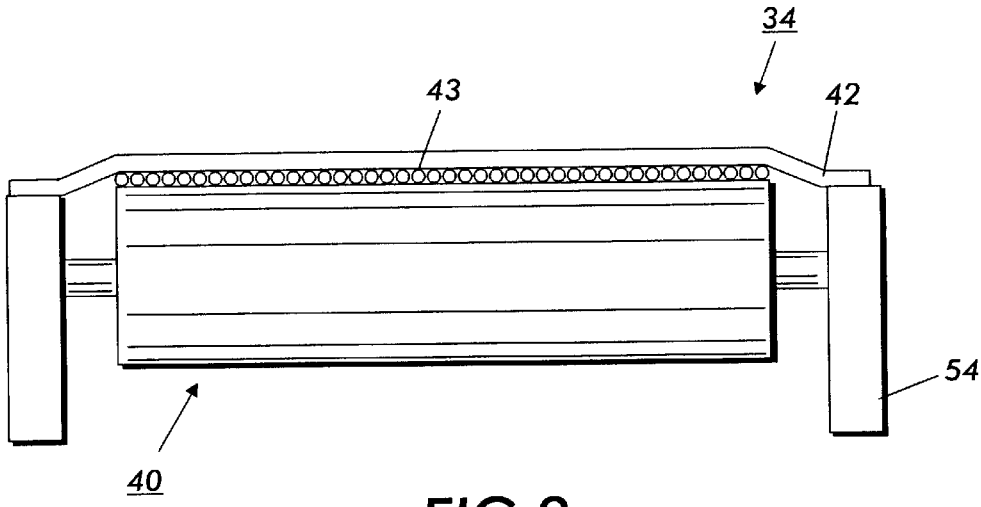
FIG. 2 is an enlarged, schematic illustration of a donor roll and electrode member representing an embodiment of the present invention.

An embodiment of the developer unit is further depicted in FIG. 2. The developer apparatus 34 (not shown in FIG. 2) comprises an electrode member 42 which is disposed in the space between the photoreceptor (not shown in FIG. 2) and the donor roll 40. The electrode 42 can be comprised of one or more thin (i.e., 50 to about 100 $\mu$m in diameter) tungsten or stainless steel electrode members which are lightly positioned at or near the donor structure 40. The electrode member is closely spaced from the donor member. The distance between the wire(s) and the donor is approximately 0.001 to about 45 $\mu$m, or from about 10 to about 25 $\mu$m or the thickness of the toner layer 43 on the donor roll. The wires as shown in FIG. 2 are self spaced from the donor structure by the thickness of the toner on the donor structure. The extremities or opposed end regions of the electrode member are supported by support members 54, which may also support the donor structure for rotation. In an embodiment, the electrode member extremities or opposed end regions are attached so that they are slightly below a tangent to the surface, including toner layer, of the donor structure. Mounting the electrode members in such a manner makes them insensitive to roll runout due to their self-spacing.

Figure 3:
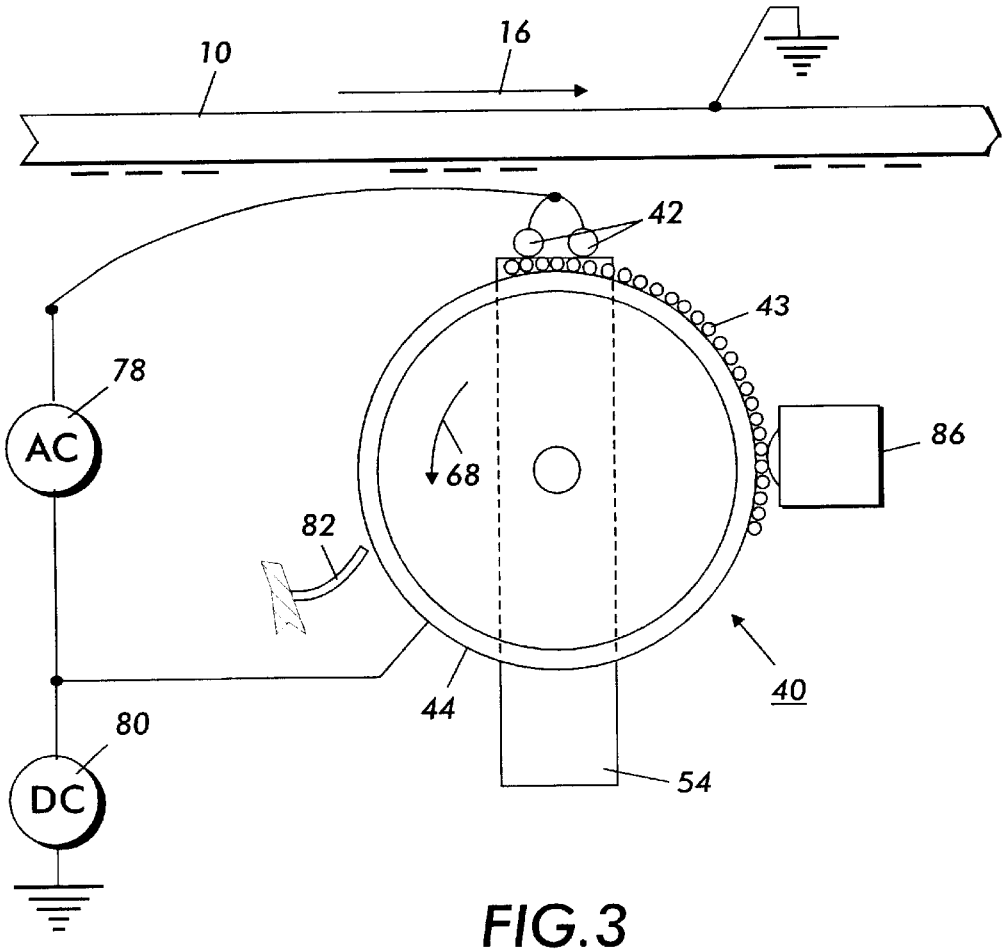
FIG. 3 is a fragmentary schematic illustration of a development housing comprising a donor roll and an electrode member from a different angle than as shown in FIG. 2.

In an alternative embodiment to that depicted in FIG. 1, the metering blade 86 is replaced by a combined metering and charging blade 86 as shown in FIG. 3. The combination metering and charging device may comprise any suitable device for depositing a monolayer of well charged toner onto the donor structure 40. For example, it may comprise an apparatus such as that described in U.S. Pat. No. 4,459,009, wherein the contact between weakly charged toner particles and a triboelectrically active coating contained on a charging roller results in well charged toner. Other combination metering and charging devices may be employed, for example, a conventional magnetic brush used with two component developer could also be used for depositing the toner layer onto the donor structure, or a donor roller alone used with one component developer.

Figure 4:
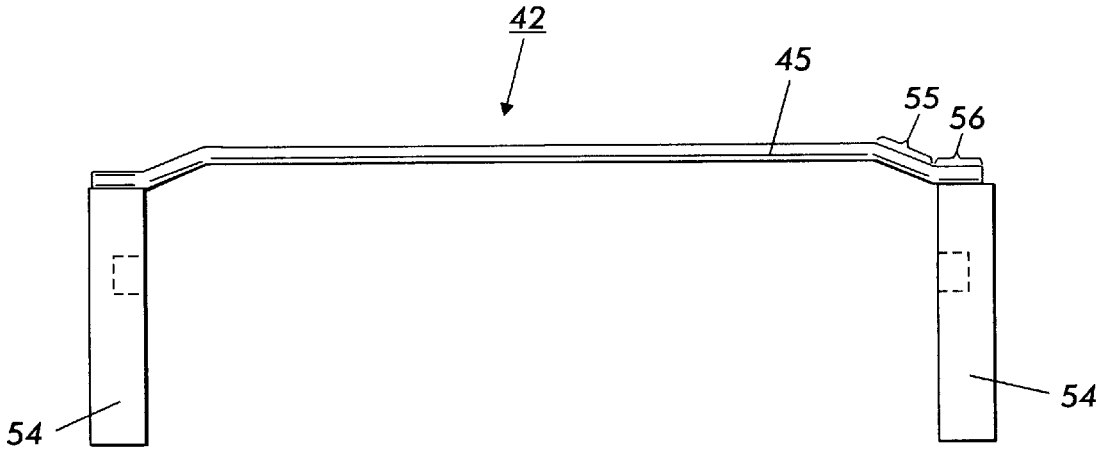
FIG. 4 is an enlarged, schematic illustration of an electrode member is supported by mounting means in an embodiment of the present invention.

FIG. 4 depicts an enlarged view of an embodiment of the electrode member of the present invention. Electrode wires 45 are positioned inside electrode member 42. The anchoring portions 55 of the electrode members are the portions of the electrode member which anchor the electrode member to the support member. The mounting sections 56 of the electrode member are the sections of the electrode members between the electrode member and the mounting means 54.

Toner particles are attracted to the electrode members primarily through electrostatic attraction. Toner particles adhere to the electrode members because the adhesion force of the toner is larger than the stripping force generated by the electric field of the electrode member. Generally, the adhesion force between a toner particle and an electrode member is represented by the general expression $F_{ad}=q^2/kr^2+W$, wherein $F_{ad}$ is the force of adhesion, q is the charge on the toner particle, k is the effective dielectric constant of the toner and any dielectric coating, and r is the separation of the particle from its image charge within the wire which depends on the thickness, dielectric constant, and conductivity of the coating. Element W is the force of adhesion due to short range adhesion forces such as van der Waals and capillary forces. The force necessary to strip or remove particles from the electrode member is supplied by the electric field of the wire during half of its AC period, qE, plus effective forces resulting from mechanical motion of the electrode member and from bombardment of the wire by toner in the cloud. Since the adhesion force is quadratic in q, adhesion forces will be larger than stripping forces for sufficiently high values of q.

Figure 5:
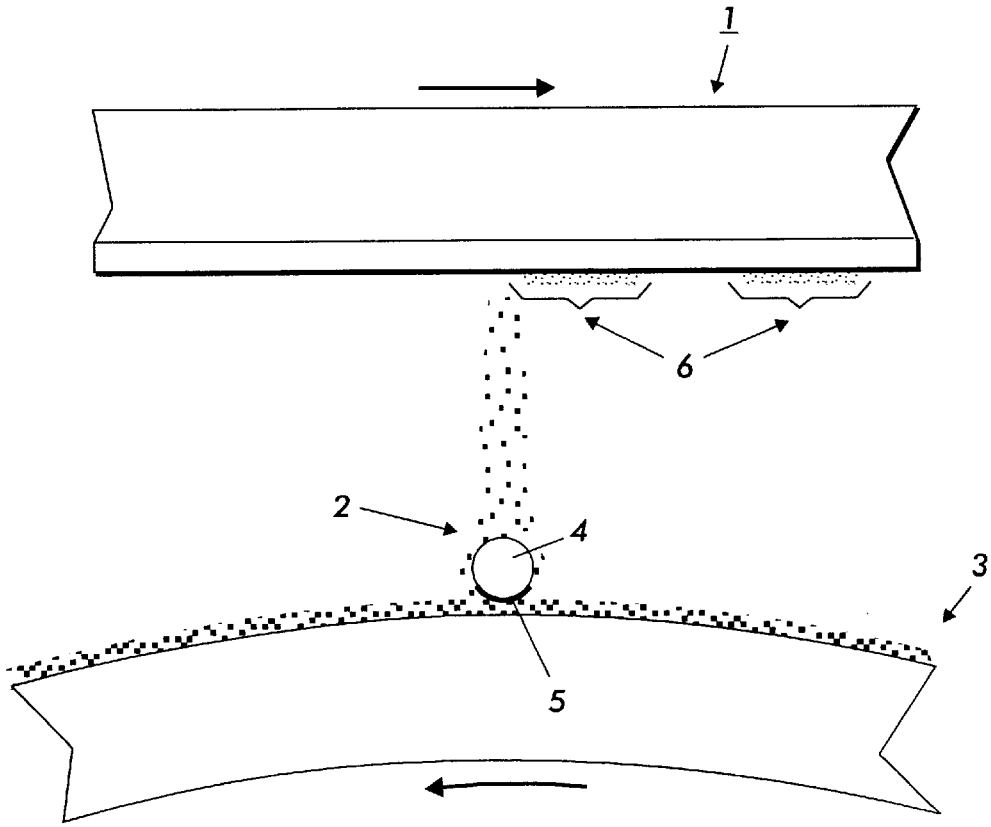
FIG. 5 (Prior Art)
FIG. 5 is an illustration of wire contamination and wire history.

FIG. 5 contains an illustration of wire contamination and wire history. A photoreceptor 1 is positioned near wire 4 and contains an undeveloped image 6 which is subsequently developed by toner originating from donor member 3. Wire contamination occurs when fused toner 5 forms between the wire 4 and donor member 3 due to toner fines and any toner components, such as high molecular weight, crosslinked and/or branched components, and the voltage breakdown between the wire member and the donor roll. Wire history is a change in developability due to toner 2 or toner components sticking to the top of the wire 4, the top of the wire being the part of the wire facing the photoreceptor.

In order to prevent the toner defects associated with wire contamination and wire history, the electrical properties of the electrode member can be changed, thereby changing the adhesion forces in relation to the stripping forces. However, such changes in the electrical properties of the electrode member may adversely affect the ability of the electrode member to adequately provide a toner cloud, which is essential for developing a latent image. The present inventors have developed a way to reduce the unacceptable accumulation of toner on the electrode member while maintaining the desired electrical and mechanical properties of the electrode member. The electrode member of the present invention is coated with a material coating that reduces the significant attraction of toner particles to the electrode member, which may result in toner accumulation. However, the material coating does not adversely interfere with the mechanical or electrical properties of the electrode member. Materials having these qualities include materials that comprise fully fluorinated polymers. In embodiments, the fully fluorinated material acts as a co-solubilizer making soluble in fluroinated solvents, materials which are not normally solvent in fluorianted solvents. In embodiments, the coating includes a fully fluorinated co-solubilizer or fully fluorinated polymer, a metal material, and a fluorinated solvent.

The fully fluorinated material decreases the accumulation of toner by assuring electrical continuity for charging the wires and eliminates the possibility of charge build-up. In addition, such fully fluorinated materials as described herein do not interfere with the electrical properties of the electrode member and do not adversely affect the electrode's ability to produce a toner powder cloud. Moreover, the electrode member maintains its tough mechanical properties, allowing the electrode member to remain durable against the severe wear the electrode member receives when it is repeatedly brought into contact with tough, rotating donor roll. surfaces. Also, the electrode member maintains a "smooth" surface after the coating is applied. A smooth surface includes surfaces having a surface roughness of less than about 5 microns, or from about 0.01 to about 1 microns of Ra roughness.

The term "fully fluorinated polymers" as used herein, refers to fluorinated polymers that do not contain any hydrocarbon chains, hydrocarbon units, hydrocarbon substituents, or any carbon-hydrogen bonds. The term "fully fluorinated polymers" includes polymers comprising fluorinated monomers containing no hydrocarbon units, and monomers that are fully fluorinated and do not contain any hydrocarbon units. In embodiments, the fully fluorinated polymers are soluble in fluorinated solvents. In embodiments, the fully fluorinated polymers may be amorphous, thereby giving them excellent light transmission properties. In embodiments, the fully fluorinated polymers are solution coatable and have a low surface energy, and therefore, smooth, thin and uniform low surface energy coatings can result. In embodiments, the fully fluorinated polymer is a co-solubilizer, and promotes solubility in fluorinated solvents, materials which are not normally soluble in fluorinated solvents.

A co-solubilizer is a substance, which when added to a mixture renders the solute of that mixture soluble by reaction with the solute. A co-solubilizer is normally soluble in the solvent. Without the co-solubilizer, the solute would otherwise not be soluble in the solvent.

Examples of suitable fully fluorinated polymers include perfluorinated siloxanes, perfluorinated styrenes, perfluorinated urethanes, copolymers of fluoropolymers and perfluoropolymers such as, copolymers of tetrafluoroethylene and fully fluorinated polymers, and copolymers of tetrafluoroethylene and oxygen-containing fully fluorinated polymers, copolymers of tetrafluoroethylene and oxy-halo-fully fluorinated fluoropolymers, and mixtures thereof.

In embodiments, the fully fluorinated polymer comprises the following Formula I:

$$((CF_2)_m—(X)_n)_o$$

wherein m is a number of from about 1 to about 100, or from about 2 to about 50, or from about 5 to about 25; n is a number of from about 1 to about 100, or from about 2 to about 50, or from about 5 to about 25; and o is a number of from about 1 to about 100, or from about 2 to about 50, or from about 5 to about 25; and wherein X is selected from the group consisting of unsubstituted or substituted, straight or branched chain fluorocarbons having from about 1 to about 50 fluorocarbons, or from about 2 to about 25 fluorocarbons; and substituted or unsubstituted cyclic fluorocarbons having from about 3 to about 20 fluorocarbons, or from about 4 to about 10 fluorocarbons; and substituted or unsubstituted oxy-halo fluorocarbons having from about 3 to about 10 fluorocarbons, or from about 4 to about 6 fluorocarbons. Other possible substituents for X include hexafluoropropylene, and/or perfluoroalkoxy substituted tetrafluoroethylene.

In embodiments, the fully fluorinated polymer has the following Formula II:

$$(CF_2)_m—(X)_n$$

wherein m, n and X are as defined in Formula I.

In embodiments, the fully fluorinated polymer has the following Formula III:

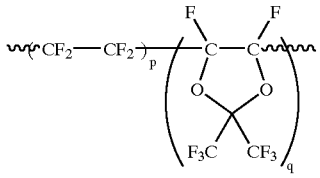

wherein p is a number of from about 1 to about 100, or from about 2 to about 50, or from about 5 to about 25; and q is a number of from about 1 to about 100, or from about 2 to about 50, or from about 5 to about 25. A commercially available perfluoropolymer having the above Formula III is TEFLON® AF, a copolymer of tetrafluoroethylene and perfluoro-2,2-dimethyl-1,3-dioxide, the latter monomer being fully fluorinated.

In embodiments, the fully fluorinated polymer has the following Formula IV:

$$((CF_2)_m—X—(CF_2)_r)_o$$

wherein o is as defined in Formula I; r is a number of from about 0 to about 50, or from about 1 to about 25, or from about 2 to about 15; and wherein X, m and o are as defined for Formula I.

In embodiments, the fully fluorinated polymer has the following Formula V:

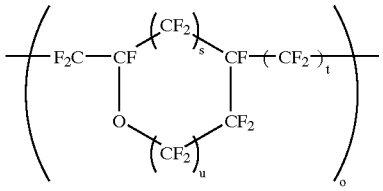

wherein s is a number of from about 0 to about 5, or from about 1 to about 3, or 2; t is a number of from about 0 to about 25, or from about 1 to about 15, or from about 5 to about 10; and u is a number of from about 0 to about 5, or from about 1 to about 3, or 2. A commercially available example of a perfluoropolymer having the above Formula IV is CYTOP® available from Asahi Glass Company.

Another specific example of a fully fluorinated material is AUSIMONT® Fluorolink F7004 from Ausimont, Thorofare, N.J. This fully fluorinated polymer is useful in solubilizing in fluorinated solvents, materials which are not normally soluble in fluorinated solvents. This fully fluorinated polymer works well as a co-solubilizer for copper complexes such as copper (ii) hexafluoropentanedionate. The fully fluorinated polymer acts as a co-solubilizer which covalently bonds the superconductor or superconductor precursor.

The fully fluorinated coating material compound or composition is present in an amount of from about 0.1 to about 40 percent by weight of total solids, or from about 2 to about 15 percent by weight of total solids. Total solids as used herein, refers to the total amount by weight of fully fluorinated material, fillers, additives, metal materials such as superconductors or superconductor precursors, solvents, and other like ingredients contained in the coating solution.

A superconductor precursor or superconductor can be used in the coating composition. Examples of superconductors or superconductor precursors include, for example, metal alkoxides, multidentate ligands of conductive metals, other superconductors, other superconductor precursors, or mixtures thereof.

The term "superconductors" as used herein refers to metals, alloys and compounds which have the ability to lose both electrical resistance and magnetic permeability at or near absolute zero. In other words, superconductors have infinite electrical conductivity at or near absolute zero. Superconductivity does not normally occur in alkali metals, noble metlas, ferro- and antiferromagnetic metals. Usually, elements having 3, 5, or 7 valence electrons per atom can be superconductors. Examples of superconductors include metals having 3, 5 or 7 valence electrons.

A superconductor precursor is a material that may be processed to form a superconductor. Organometallic compounds are typically processed via chemical vapor deposition (CVD) to produce films which can be either superconductors or can possess other unique properties such as chemochromic or thermochromic properties. MOCVD refers to metal-organic chemical vapor deposition. Organometallics that can be processed to create superconductor films are referred to as superconductor precursors.

Other examples of suitable superconductors include metal oxide superconductors comprising admixtures of metals from Groups IB, IIA, and IIIB of the Periodic Table. Illustrative materials of such type include the metal oxide superconductors of the yttrium-barium-copper type ($YBa_2Cu_3O_y$) type, the so-called "123" high temperature superconductors (HTSC) materials, wherein y may be from about 6 to about 7.3, as well as materials where Y may be substituted by Nd, Sm, Eu, Gd, Dy, Ho, Yb, Lu, $Y_{0.5}$—$Sc_{0.5}$, $Y_{0.5}$—$La_{0.5}$, and $Y_{0.5}$—$Lu_{0.5}$, and where Ba may be substituted by Sr—Ca, Ba—Sr, and Ba—Ca. Another illustrative class of superconductor materials includes those of the general formula $(AO)_mM_2Ca_{n-1}Cu_nO_{2n+2}$, wherein the A cation can be thallium, lead, bismuth, or a mixture of these elements, m=1 or 2 (but is only 2 when A is bismuth), n is a number of from about 1 to about 5, M is a cation such as barium or stronium, and the substitution of calcium by strontium frequently is observed, as described in "High Tc Oxide Superconductors," MRS Bulletin, January, 1989, pp. 20–24, and "High Tc Bismuth and Thallium Oxide Superconductors," Sleight, A. W., et al., MRS Bulletin, January, 1989, pp. 45–48. Other examples include $Yba_2Cu_3O_{7-x}$ (see P. P. Edwards et al. *Chemistry Britain,* 1987, pp. 23–26; $Pb_2Sr_2LnCu_3)O_{8-x}$ (see M. O'Keefe et al., *J. Am. Chem. Soc.* 1988, 110, 1506; $La_{2-x}Sr_xCuO_4$ (see Bednorz and Muller, *Z. Phys. B. Cond. Matter,* 1986, 64, pp 189–195, and the like.

Specific examples of superconductors or precursors of superconductors include organometallic compounds such as copper (II) hexafluoropentanedionate, copper (II) methacryloxyethylacetonacetonate, antimony ethoxide, indium hexafluoropentandionate, and the like, and mixtures thereof. Some of these may not be necessarily considered superconductors, but may be considered direct precursors for superconductors via a chemical coating process such as chemical vapor deposition (CVD).

Other metal materials include monodentate, bidentate or multidentate ligand such as beta-diketonates, cyclopentadienyls, alkyls, perfluoroalkyls, alkoxides, perfluoroalkoxides, and Schiff bases. Other examples of bidentate or multidentate ligands may comprise oxyhadrocarbyl ligands, nitrogenous oxyhydrocarbyl ligands, or fluorooxyhydrocarbyl ligands. The multidentate ligand may be selected from the group consisting of amines and polyamines, bipyridines, ligands of the Formula IV:

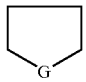

wherein G is —O—, —S—, or —NR—, wherein R is H or hydrocarbyl; crown ethers or cryptates; and ligands of the formula $R^0O(C(R_1)_2C(R^2)_2O)_nR^0$, wherein $R^0$ is selected from the group consisting of hydrogen, methyl, ethyl, n-propyl, cyanato, perfluoroethyl, perfluoro-n-propyl, or vinyl; $R^2$ is hydrogen, fluorine, or a sterically acceptable hydrocarbyl subsitutent; $R^2$ is hydrogen, fluorine or a sterically acceptable hydrocarbyl substitutent; n is 4, 5, or 6 and $R^0$, $R^1$ and $R^2$ may be the same or different from each other.

Examples of organometallic additives include those having the following Formula VII:

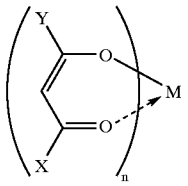

where M may be selected from the group consisting of Al, Ba, Be, Bi, Cd, Ca, Ce, Cr, Co, Cu, Ga, Hf, In, Ir, Fe, Pb, Li, Mg, Mn, Mo, Ni, Pd, Pt, K, Dy, Er, Eu, Gd, Ho, La, Nd, Pr, Sm, Sc, Tb, Tm, Yb, Y, Rh, Ru, Si, Ag, Na, Sr, Ta, Tl, Sn, Ti, V, Zn, Zr, and the like; X or Y may be a hydrocarbon chain having from about 1 to about 30 carbons, or from about 3 to about 12 carbons; a fluorocarbon having from about 1 to about 30 carbons or from about 3 to about 12 carbons, or having from about 1 to about 20 fluorocarbon units of from about 3 to about 8 fluorocarbon units; a substituted or unsubstituted alkoxy group such as methoxy, propoxy, ethoxy, butoxy, pentoxy, and the like; substituted or unsubstituted acyclic group having from about 4 to about 12 carbons such as cyclobutane, cyclopentane, benzene, a phenyl group is such as phenol, cycloheptane, and the like; and wherein n is a number of from about 1 to about 100, or from about 1 to about 20, or from about 1 to about 4.

The organometallic compound may be present in the coating composition in an amount of from about 10 to about 250 parts per hundred, or from about 25 to about 200 parts per hundred, or from about 50 to about 200 parts per hundred organometallic material:polymer.

Any suitable fluorinated solvent may be used with the fully fluorinated polymer and optional metal material. A fluorinated solvent is a solvent comprising fluorine. In embodiments, the fluorinated solvents have low surface energy and low surface tension. Examples of fluorinated solvents include any partially fluorinated organic molecule having a carbon chain with from about 2 to about 25 carbons, or from about 5 to about 15 carbons, and in embodiments, contains carboxylic acid functionality.

The volume resistivity of the coated electrode is for example from about $10^{-10}$ to about $1^{-1}$ ohm-cm, or from $10^{-5}$ to $10^{-1}$ ohm-cm. The surface roughness (Ra) is less than about 5 microns or from about 0.01 to about 1 micron. The low surface energy is from about 5 to about 35 dynes/cm or from about 10 to about 25 dynes/cm.

In an embodiment of the invention, the material coating is coated over at least a portion of the nonattached regions of the electrode member. The nonattached region of the electrode member is the entire outer surface region of the electrode minus the region where the electrode is attached to the mounting means 54 and minus the anchoring area (55 in FIG. 4). In an embodiment, the coating covers the portion of the electrode member, which is adjacent to the donor roll. In another embodiment of the invention, the material coating is coated on an entire area of the electrode member located in a central portion of the electrode member and extending to an area adjacent to the nonattached portion of the electrode member. This area includes the entire surface of the electrode member minus the anchoring area (55 in FIG. 4). In an alternative embodiment, the entire length of the electrode member is coated with the material coating, including the anchoring area 55 and mounting area 56. In embodiments, at lease a portion refers to the non-attached region being coated, or from about 10 to about 90 percent of the electrode member.

Toner can accumulate anywhere along the electrode member, but it will not affect development unless it accumulates in the length of the electrode member near to the donor roll or on the length closest to the photoreceptor. Therefore, in an embodiment, the material coating covers the electrode member along the entire length corresponding to the donor roll, and on the entire length corresponding to the photoreceptor.

The material coating may be deposited on at least a portion of the electrode member by any suitable, known method. These deposition methods include liquid and powder coating, dip and spray coating. In a deposition method, the material coating is coated on the electrode member by dip coating. The curing time can be controlled by the concentration of catalyst, temperature, or both.

The fully fluorinated polymer coating can be coated to a very thin coating, such as, for example, from about 1 to about 5 $\mu$m thick, or from about 1 to about 2 $\mu$m thick. If the coating is applied to only a portion of the electrode member, the thickness of the coating may or may not taper off at points farthest from the midpoint of the electrode member. Therefore, the thickness of the coating may decrease at points farther away from the midpoint of the electrode.

In an embodiment of the invention, a primer is used in addition to the organic coating. The thickness of the primer is from about 0.01 to about 0.1 microns, or from about 0.01 to about 0.5 microns, or from about 0.01 to about 0.05 microns. An example of a specific primer is DOW CORNING 1200, which is an orthosilicate orthotitanate primer. Other primers may include n-(2-aminoethyl)-3-aminopropyltrimethoxysilane (Gelest product code SIA0591.0), (3- glycidoxypropyl)trimethoxysilane (Gelest Product code SIG5840.0), and methacryloxypropyl trimethoxysilane (Gelest Product Code SIM6487.4).

A filler such as an electrically conductive filler, may be added to the material coating in the amount of from about 5 to about 35 percent by weight of total solids, or from about 15 to about 20 percent by weight of total solids. Total solids herein include the amount of fully fluorinated polymer, fluorinated solvent, metal material, fillers, and any other additives.

Examples of electrically conductive fillers include carbon black fillers (such as carbon black such as BLACK PEARL®), fluorinated carbon black (such as ACCUFLUOR® or CARBOFLUORO®), graphite, or the like, and mixtures thereof; metals such as calcium, magnesium, calcium hydroxide, magnesium hydroxide, and the like, and mixtures thereof; metal oxides such as antimony oxide, tin oxide, indium oxide, titanium oxide, zirconium oxide, and the like, and mixtures thereof; doped metal oxides such as antimony doped tin oxide, aluminum doped zinc oxide, antimony doped titanium dioxide, and the like, and mixtures thereof; polymer fillers such as polytetrafluoroethylene powder, polyaniline powder, and the like, and mixtures thereof; and nanocomposites such as fluorinated nanocomposites.

Fluorinated nanocomposites can be added as in-situ sol-gel derived filler networks as described in U.S. Pat. Nos. 5,726,247 and 5,876,686 to Dupont. Key benefits are improved adhesion and wear resistance.

The electrode members exhibit superior performance in terms of low surface energy, and decreased accumulation of toner on the surface of the electrode member, while also maintaining electrical properties which stimulate production of powder cloud development without charge build-up. In addition, the electrode members herein exhibit superior mechanical properties such as durability against donor roll surfaces, which are normally made of tough materials such as ceramics.

In addition, the fully fluorinated coatings provide a very thin, robust, yet smooth surface, which reduces or eliminates the occurrence of wire history contamination.

Other applications for the above fully fluorinated polymer coatings in addition to use as coatings for wires, include electrically or thermal conductive soluble fluoropolymer-ceramic hybrids or intermediates, electroluminescent fluorinated fluids or polymer coatings, photosensitive fluorinated fluids or coatings, colored fluorinated fluids or soluble polymer coatings for display devices, fluorinated carrier fluids for metal oxide film formation (where low surface tension of fluorinated fluids are desirable), thermochromic fluorescent or electrochromic fluorinated fluids or coatings, and many other applications.

All the patents and applications referred to herein are hereby specifically, and totally incorporated herein by reference in their entirety in the instant specification.

The following Examples further define and describe embodiments of the present invention. Unless otherwise indicated, all parts and percentages are by weight.

EXAMPLES

Example 1

Dip Coating of a Wire

A dip coating apparatus consisting of a 1 inch (diameter) by 15 inches (length) glass cylinder sealed at one end to hold the liquid coating material was used for dip coating a wire. A cable attached to a Bodine Electric Company type NSH-12R motor was used to raise and lower a wire support holder that keeps the wire taut during the coating process. The dip and withdraw rate of the wire holder into and out of the coating solution was regulated by a motor control device from B&B Motors & Control Corporation, (NOVA PD DC motor speed control). After coating, a motor driven device was used to twirl the wire around its axis while it received external heating to allow for controlled solvent evaporation. When the coating was dry and/or non-flowable, the coated wire was heated in a flow-through oven using a time and temperature schedule to complete either drying or cure/post cure of the coating.

The general procedure may include: (A) cleaning and degreasing the wire with an appropriate solvent, for example, acetone, alcohol or water, and roughened if necessary by, for example, sand paper; (B) optionally applying a primer, for example Dow Corning 1200; (C) the coating material may be adjusted to the proper viscosity and solids content by adding solids or solvent to the solution; (D) the wire is dipped into and withdrawn from the coating solution, dried and cured/post cured, if necessary, and dipped again, if required. The coating thickness and uniformity are a function of withdrawal rate and solution viscosity, (solids content in most solvent based systems) and a drying schedule consistent with the uniform solidification of the coating.

Coated and untested wires were evaluated microscopically for morphology, defects, coating thickness and a qualitative softness/hardness estimate. Wires that passed these evaluations were vibrated on a rack and then examined microscopically for coating integrity. Racks or modules containing wires that showed no coating defects were then fitted on a fixture where the wire was pressed against a rotating ceramic roll for a standard time, after which the wire was then examined for coating wear and cleanliness.

Example 2

Preparation of Multidentate Ligand in Fluorinated Solvent Solution

An amount of 0.05 grams (0.0001 moles) of an organometallic bidentate ligand (copper II hexafluoropentanedionate) was added to 5.0 grams of 3M Fluorinert FC-75 (a fluorinated solvent). At this point, the superconductor precursor (CuHFP) was not soluble in the fluorinated solvent.

Example 3

Solubilization of Multidentate Ligand in Fluorinated Solvent Solution

To the mixture formed in Example 2, an amount of 0.5 g (approximately 0.0008 moles) of Ausimont Fluorolink 7004 (fully fluorinated co-solubilizer) was added. The resulting combination formed a green-blue solution.

The CuHFP was insoluble in FC-75 (fluorinated solvent) until the Fluorolink F7004 (fully fluorinated co-solubilizer) was added.

Example 4

Solubilization of Multidentate Ligand in Fluorinated Solvent Solution

To the solution formed in Example 2, an amount of 5 grams of a 1 weight percent solution of a fully fluorinated polymer (TEFLON® AF 2400) in a fluorinated solvent (FC-75) was added. The resulting solution was blue-green and exhibited no signs of insolubility or immiscibility.

Example 5

Testing of Coated Solutions

A 304V HYTEN® stainless steel, 2.5 mil diameter wire was obtained from Fort Wayne Metals. The wire was pretreated and coated by Applied Plastics using a proprietary trade secreted method. The wire can be coated by any known coating method. The coating formulations used were as follows. Samples 1 and 2 were coated with XYLAN® 1220/D2810 (D2340) (a thermosetting resin binder with fluorinated ethylene propylene and conductive carbon black) obtained from Whitford Worldwide, Frazer, Pa. Sample 3 was coated with a fully fluorinated TEFLON® AF 2400 (copolymer of tetrafluoroethylene and fully fluorinated 2,2-bis(trifluoromethyl)-4,5-difluoro-1,3-dioxolane obtained from DuPont) in a 1% solids solution dissolved in a fluorinated solvent (FC-75 from 3M).

Figure 6:
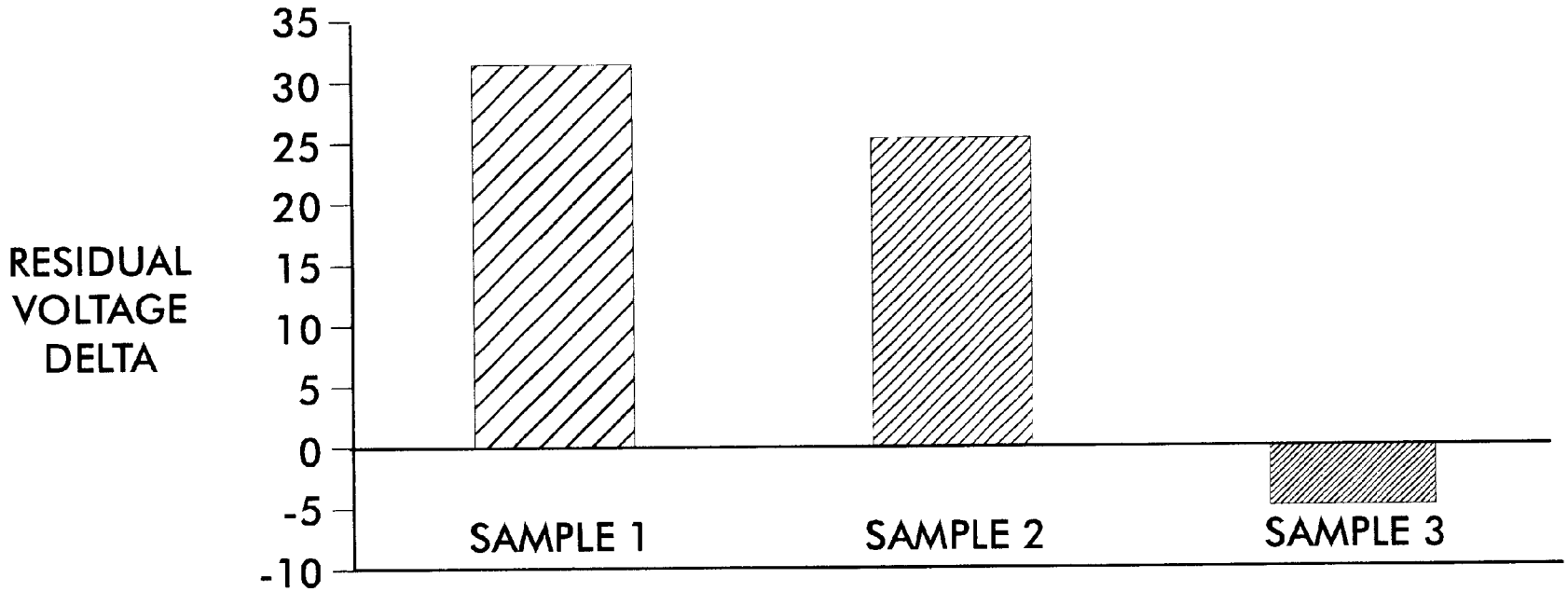
FIG. 6 is a bar graph of residual potential for two comparative known non-fully fluorinated wire coatings and a fully fluorinated coating.

FIG. 6 demonstrates the results of testing the 3 samples for wire history contamination. FIG. 6 shows data for residual potential (V). As a wire becomes contaminated, toner and additives adhere to the surface of the wire, creating a hard coating that will hold a residual potential when corona-charged. A lower potential indicates more favorable wire contamination performance. FIG. 6 clearly shows that a wire coated with a fully fluorinated polymer coating provides superior results in terms of reduced or eliminated wire history contamination when compared to hydrocarbon-containing fluoropolymer coatings.

While the invention has been described in detail with reference to specific embodiments, it will be appreciated that various modifications and variations will be apparent to the artisan. All such modifications and embodiments as may readily occur to one skilled in the art are intended to be within the scope of the appended claims.

What is claimed is:

1. An apparatus for developing a latent image recorded on a surface, comprising:

wire supports;

a donor member spaced from the surface and being adapted to transport toner to a region opposed from the surface:

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a polymer comprising a fully fluorinated polymer soluble in a fluorinated solvent.

2. An apparatus in accordance with claim 1, wherein said fully fluorinated polymer has the following Formula I:

$$((CF_2)_m—(X)_n)_o$$

wherein m is a number of from about 1 to about 100, n is a number of from about 1 to about 100, and o is a number of from about 1 to about 100, and wherein X is selected from the group consisting of straight chain fluorocarbons having from about 1 to about 50 fluorocarbons; branched fluorocarbons having from about 1 to about 50 fluorocarbons; cyclic fluorocarbons having from about 3 to about 20 fluorocarbons; and oxy-halo fluorocarbons having from about 3 to about 10 fluorocarbons.

3. An apparatus in accordance with claim 2, wherein said fully fluorinated polymer has the following Formula III:

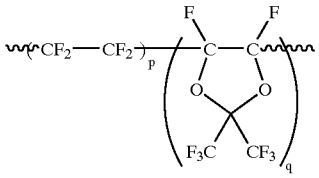

wherein p is a number of from about 1 to about 100, and q is a number of from about 1 to about 100.

4. An apparatus in accordance with claim 2, wherein said fully fluorinated polymer has the following Formula IV:

$$((CF_2)_m—X—(CF_2)_r)_o$$

wherein m is a number of from about 1 to about 100, o is a number of from about 1 to about 100, r is a number of from about 0 to about 50, and wherein X is selected from the group consisting of straight chain fluorocarbons having from about 1 to about 50 fluorocarbons; branched fluorocarbons having from about 1 to about 50 fluorocarbons; cyclic fluorocarbons having from about 3 to about 20 fluorocarbons; and oxy-halo fluorocarbons having from about 3 to about 10 fluorocarbons.

5. An apparatus in accordance with claim 4, wherein said fully fluorinated polymer has the following Formula V:

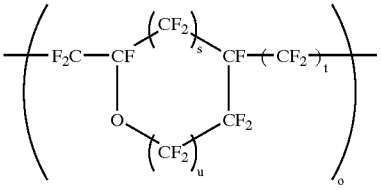

wherein o is a number of from about 1 to about 100, s is a number of from about 0 to about 5, t is a number of from about 0 to about 25, and u is a number of from about 0 to about 5.

6. An apparatus in accordance with claim 1, wherein said fully fluorinated polymer is present in the coating in an amount of from about 0.1 to about 40 percent by weight of total solids.

7. An apparatus in accordance with claim 1, wherein said polymer is selected from the group consisting of perfluorinated siloxanes perfluorinated styrenes, perfluorinated urethanes, and copolymers of tetrafluoroethylene and perfluoropolymer.

8. An apparatus in accordance with claim 1, wherein said polymer is a copolymer of tetrafluoroethylene and an oxy-halo perfluoropolymer.

9. An apparatus in accordance with claim 1, wherein said polymer is a copolymer of tetrafluoroethylene and perfluoro-2,2-dimethyl-1,3-dioxide.

10. An apparatus in accordance with claim 1, wherein said coating further comprises a metal material selected from the group consisting of superconductors and superconductor precursors.

11. An apparatus in accordance with claim 10, wherein said metal material is selected from the group consisting of monodentate ligands, multidentate ligands, and metal alkoxides.

12. An apparatus in accordance with claim 10, wherein said metal material is selected from the group consisting of copper (II) hexafluoropentanedionate, copper (II) methacryloxyethylacetonacetonate, antimony ethoxide, indium hexafluoropentandionate, and mixtures thereof.

13. An apparatus in accordance with claim 10, wherein said metal material is present in the coating in an amount of from about 5 to about 35 percent by weight of total solids.

14. An apparatus in accordance with claim 1, wherein said coating further comprises a fluorinated solvent.

15. An apparatus in accordance with claim 14, wherein said fluorinated solvent comprises a carbon chain having from about 2 to about 25 carbons.

16. An apparatus in accordance with claim 14, wherein said fluorinated solvent comprises carboxylic acid functionality.

17. An apparatus in accordance with claim 1, wherein said coating has a thickness of from about 1 $\mu$m to about 5 $\mu$m.

18. An apparatus in accordance with claim 1, wherein said coating is present on from about 10 to about 90 percent of said electrode member.

19. An apparatus in accordance with claim 1, wherein said electrode member includes more than one thin diameter wires.

20. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a) a polymer comprising a fully fluorinated polymer and b) a fluorinated solvent.

21. An apparatus for developing a latent image recorded on a surface, comprising:

wire supports;

a donor member spaced from the surface and being adapted to transport toner to a region opposed from the surface;

an electrode member positioned in the space between the surface and the donor member, the electrode member being closely spaced from the donor member and being electrically biased to detach toner from the donor member thereby enabling the formation of a toner cloud in the space between the electrode member and the surface with detached toner from the toner cloud developing the latent image, wherein opposed end regions of the electrode member are attached to wire supports adapted to support the opposed end regions of said electrode member; and a coating on at least a portion of nonattached regions of said electrode member, wherein said coating comprises a) a polymer comprising a fully fluorinated polymer, b) a fluorinated solvent, and c) a superconductor precursor.

* * * * *